US005339582A

United States Patent [19]

Sells

[11] Patent Number: 5,339,582

[45] Date of Patent: Aug. 23, 1994

[54] ROOF VENT

[76] Inventor: Gary L. Sells, 16250 Petro Dr., Mishawaka, Ind. 46544

[21] Appl. No.: 110,855

[22] Filed: Aug. 24, 1992

Related U.S. Application Data

[63] Continuation of Ser. No. 48,572, Apr. 16, 1993, abandoned, and a continuation of Ser. No. 793,013, Nov. 15, 1991, abandoned.

[51] Int. Cl.[5] ..... F24F 7/02

[52] U.S. Cl. ..... 52/198; 52/43; 52/47; 52/57; 52/199; 454/365

[58] Field of Search ..... 52/43, 47, 57, 58, 95, 52/198, 199; 454/365, 366, 367

[56] References Cited

U.S. PATENT DOCUMENTS

| | | | |
|---|---|---|---|
| 865,961 | 9/1907 | Zilly | 52/278 |
| 2,214,183 | 9/1940 | Seymour | 52/199 X |
| 2,704,500 | 3/1955 | Bonforte | 454/365 |
| 3,241,474 | 3/1966 | Rousey et al. | 454/365 |
| 3,481,263 | 12/1969 | Belden | 454/365 |
| 3,949,657 | 4/1976 | Sells | 454/365 |
| 4,325,290 | 4/1982 | Wolfert | 454/365 |
| 4,545,291 | 10/1985 | Kutsch et al. | 454/365 |
| 4,558,637 | 12/1985 | Mason | 454/365 |
| 4,573,291 | 3/1986 | Hoffmann | 52/43 |

*Primary Examiner*—Carl D. Friedman
*Assistant Examiner*—Robert J. Canfield
*Attorney, Agent, or Firm*—James D. Hall

[57] ABSTRACT

An air dam or adjustable part mounted on a vent having openings extending traversely and placed upon the ridge of a roof. The air dam includes an outturned upper flange and a lower leg with the outer edge of the flange being spaced from the inner surface of a covering over the roof ridge to ensure proper air flow from the roof peak and to form a barrier against the ingress of wind driven moisture downwardly into the vent openings,

20 Claims, 1 Drawing Sheet

ROOF VENT

This is a continuation of U.S. patent application Ser. No. 08/048,572 filed Apr. 16, 1993 and U.S. patent application Ser. No. 07/793,013 filed Nov. 15, 1991, both now abandoned. This invention relates to the vents for installation in roofs.

BACKGROUND OF THE INVENTION

In ventilation systems for a house or building structure, a balanced ventilation is desired in that it best utilizes the three natural forces of air pressure, thermal effect and diffusion. Ventilation air will move into the attic area of the structure through vents located within the positive pressure (intake) areas and will exhaust through the vent opening at the negative pressure areas located along the ridge of the roof. Wind moving over the ridge "draws" the air out of these ridge vents. In previous inventions, ridge vents covered by tile were not adequately protected from the ingress of weather elements such as rain and snow.

SUMMARY OF THE INVENTION

This invention eliminates such moisture problems by attaching to each ridge vent a flashing having an air dam formed on the upper part of the flashing. The air dam is folded away from the vent with its edge spaced at a distance away from the inner surface of the tile which covers the ridge vent. The edge of the air dam terminates spacedly from the tile's inner surface. The ridge vents are attached to a center board which extends along the peak of the roof. The tile is mounted over the center board. The flashings are applied over the outside of the vents to form passageways under the tile covering. This protects the vent from the weather and ensures proper air flow. The vertical spacing of the flashing air dam allows the ridge vent to work with the most efficiency.

It is an object of this invention to provide a proper balanced ventilation system that best utilizes the three natural forces of air pressure, thermal effect and diffusion.

It is another object of this invention to provide protection of roof air vents from the weather elements.

It is another object of this invention to allow a ridge vent to accommodate many types of tile and roof designs.

Other objects will become apparent upon a reading of the following description.

DESCRIPTION OF THE PREFERRED EMBODIMENT

Figure 1:
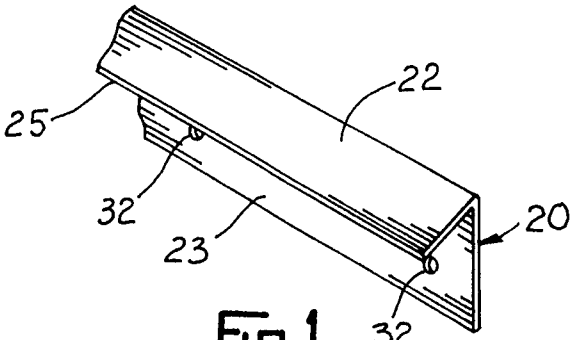
FIG. 1 is a fragmentary perspective view of the air dam forming a part of this invention.
Figure 3:
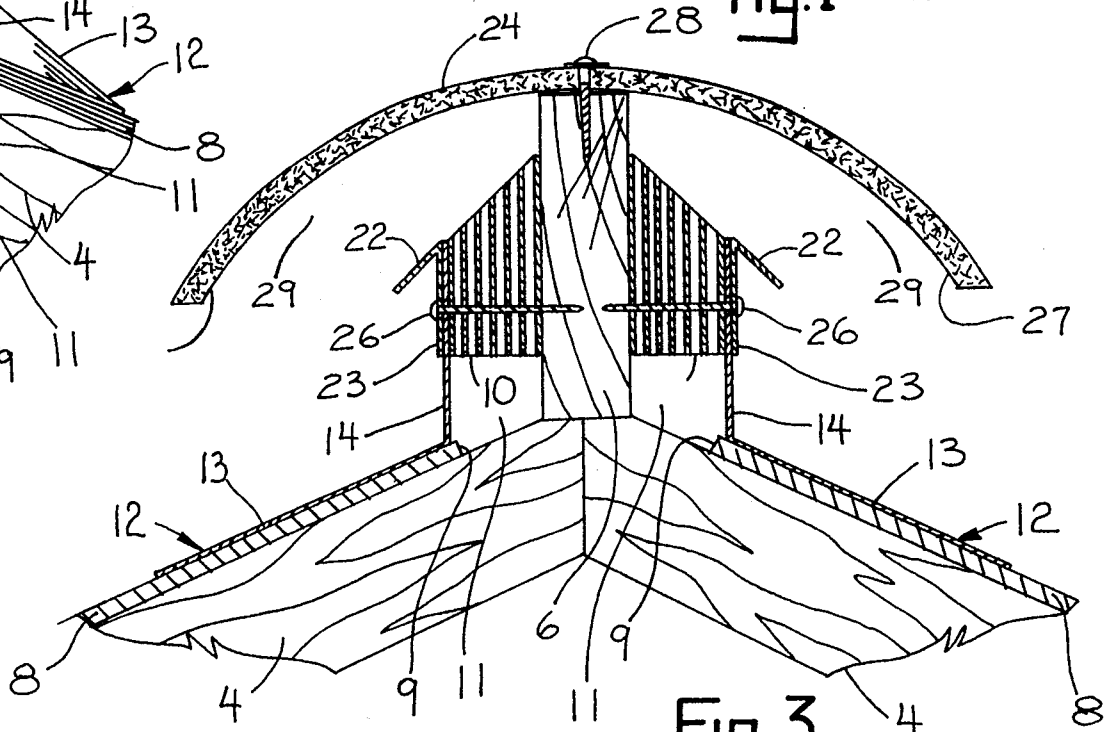
FIG. 3 is a fragmentary cross-sectional view taken along line 3—3 of FIG. 2.
Figure 2:
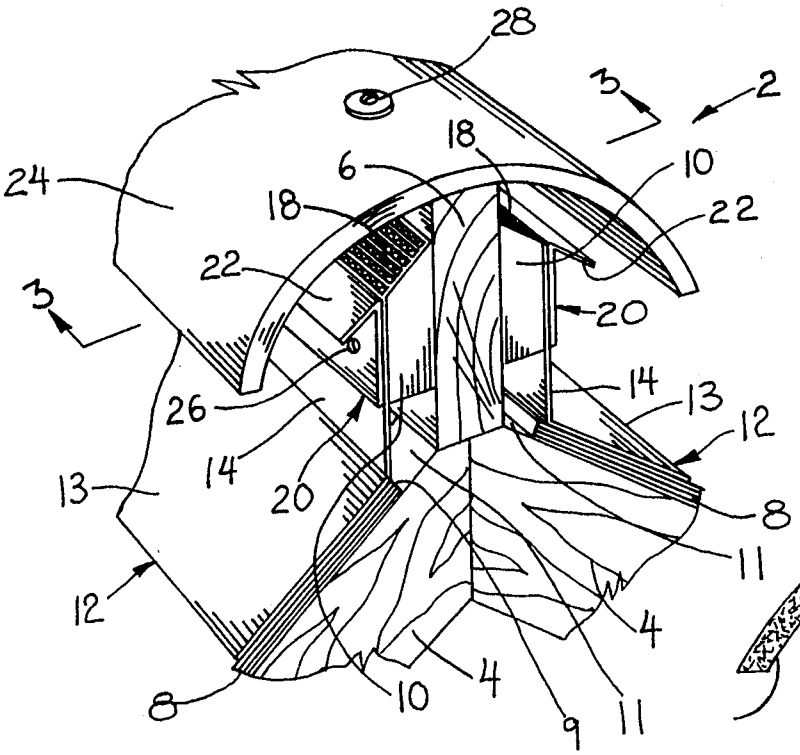
FIG. 2 is a perspective view of the air dam applied to the tile ridge vent as seen from the end of the roof.

The preferred embodiment herein described is not intended to be exhaustive or to limit the invention to the precise forms disclosed. It is chosen and described to explain the principles of the invention and its application and practical use so that others skilled in the art may follow its teachings.

A fragmented portion of the roof is illustrated in the figures. Roof peak 2 includes a plurality of longitudinally spaced inclined rafters 4 abutted against each other. A center or ridge board 6 extends longitudinally along the center of the roof and is fastened upon the rafters 4 at their intersection. A section of the rafters at their intersection is cut horizontally to allow the center board 6 to be seated therein. Roof sheeting 8 overlies the rafters with the upper edge 9 of the sheeting being spaced from ridge board 6 to provide ventilation openings for the roof, Adjacent each side face of the board 6 is secured a vent part 10 angled at its upper edge. Each vent part 10 includes openings 18. A siding flashing 12 extends along ridge board 6 and is mounted between each vent part 10 and the adjacent roof sheeting 8 to provide an air path 11 from under roof peak 2 through vertical openings 18 in vent parts 10. Each siding flashing 12 includes one angled base part 13 which overlies sheeting 8 and a vertical part 14 which overlies the outer side of the adjacent vent part 10.

The elongated air dam or flashing part 20 of this invention is an integral part of the roof vent. It should be noted that the air dam can be formed either as an integral part of siding flashing 12 or as shown in this described embodiment, as a separate component. Air dam 20 includes an outturned upper flange 22 and a lower leg 23. Air dam 20 extends the length of each vent part 10. A series of spaced apart holes 32 for the insertion of screws 26 are formed in leg 23 of each air dam 20. An air dam 20 is placed or fitted against the siding flashing 12 at each side of the vent and located with its upper flange 22 spaced from overlying tile 24. The outer edge 25 of dam flange 22 is preferably spaced a distance of approximately the thickness or width of the vent from the inner surface 27 of tile 24. This position of each air dam 20 ensures proper air flow from roof peak 2, through vent openings 18 and out the opening 29 formed between each dam flange 22 and tile 24. Each air dam 20 is secured in position by screws 26 inserted through leg openings 32 of the dam and turned through the underlying sliding flashing 12 and vent part 10 into outer board 6. Tile 24 covering the center board is fastened to the board using screws 28 (only one shown).

Air dams 20 serve to substantially prevent the ingress of wind driven moisture from passing under tile 24 and downwardly through vent parts 10 into the structure interior under the roof peak. Other tile or roofing shingles will be applied over sheeting 8.

It is understood that the above description does not limit the invention to the given details, but may be modified within the scope of the following claims.

I claim:

1. A vent for a roof having a ventilation opening, a vent part mounted over said ventilation opening, said vent part having passage means for exhausting air from under said roof, a covering mounted in a spaced relationship over and extending away from said vent part, flashing means contacting and extending upwardly along said vent part and outwardly toward said covering, said flashing means terminating spacedly from said covering and constituting means for forming a barrier against the ingress of wind driven moisture downwardly into said vent part passage means while providing an opening with said covering to allow air flow from under said roof to exhaust through said vent part passage means.

2. A roof having a ventilation opening, a board extending longitudinally over said ventilation opening, said board having opposite sides, a portion of said opening being exposed and located adjacent to each of said sides of said board, a vent part attached to each side of said board over a said opening portion, said vent part having passage means for exhausting air from under said roof, a covering supported by said board and mounted in a spaced relationship over and extending away from each vent part, flashing means contacting and extending adjacently upwardly along each vent part, said flashing means terminating spacedly from said covering and constituting means for forming a barrier against the ingress of wind driven moisture downwardly into said passage means of the vent part while providing an opening with said cover to allow air flow from under said roof to exhaust through the vent part passage means.

3. The combination of claim 2 wherein said covering is mounted to said board.

4. The combination in claim 2 wherein said flashing means extends outwardly toward said covering.

5. The combination of claim 2 wherein said covering is tile.

6. A vent for a roof having a ventilation opening, a vent part mounted over said ventilation opening, said vent part having passage means for exhausting air from under said roof, a covering mounted in a spaced relationship over and extending away from said vent part, flashing means extending upwardly along said vent part and outwardly toward said covering, said flashing means terminating spacedly from said covering and constituting means for forming a barrier against the ingress of wind driven moisture downwardly into said vent part passage means while providing an opening with said covering to allow air flow from under said roof to exhaust toward said vent part passage means, roof sheeting outlining said ventilation opening, said flashing means including a first flashing part and a second flashing part, said first flashing part extending along said sheeting and upwardly along said vent part, and second flashing part overlying said first flashing part, said second flashing part including an outturned flange terminating spacedly from said covering.

7. A roof having a ventilation opening, a board extending longitudinally over said ventilation opening, said board having opposite sides, a portion of said opening being exposed and located adjacent to each of said sides of said board, a vent part attached to each side of said board over a said opening portion, said vent part having passage means for exhausting air from under said roof, a covering supported by said board and mounted in a spaced relationship over and extending away from each vent part, flashing means extending adjacently upwardly along each vent part, said flashing means terminating spacedly from said covering and constituting means for forming a barrier against the ingress of wind driven moisture downwardly into said passage means of the vent part while providing an opening with said cover to allow air flow from under said roof to exhaust through the vent part passage means, roof sheeting outlining said ventilation opening, each flashing means including a first flashing part and a second flashing part, said first flashing part extending along said sheeting and upwardly along a said vent part, said second flashing part overlying said first flashing part, said second flashing part including an outturned flange terminating spacedly from said covering.

8. A vent for a roof having a ventilation opening, a vent part mounted over said ventilation opening, said vent part having vertical passage means for exhausting air from under said roof, a covering mounted in a spaced relationship over and extending away from said vent part, flashing means extending upwardly along said vent part and outwardly toward said covering, said flashing means terminating spacedly from said covering and constituting means for forming a barrier against the ingress of wind driven moisture downwardly into said vent part passage means while providing an opening with said covering to allow air flow from under said roof to exhaust toward said vent part passage means.

9. A vent for a roof having a ventilation opening, a vent part mounted over said ventilation opening, said vent part having passage means for exhausting air from under said roof, a covering mounted over and extending away from said vent part with at least a portion of said covering being spaced from said passage means, flashing means contacting and extending upwardly along said vent part and outwardly toward said covering, said flashing means terminating spacedly from said covering and constituting means for forming a barrier against the ingress of wind driven moisture downwardly into said vent part passage means while providing an opening with said covering to allow air flow from under said roof to exhaust through said vent part passage means.

10. The vent of claim 9 wherein said covering is spaced from said vent part.

11. A roof having a ventilation opening, a board extending longitudinally over said ventilation opening, said board having opposite sides, a portion of said opening being exposed and located adjacent to each of said sides of said board, a vent part attached to each side of said board over a said opening portion, said vent part having passage means for exhausting air from under said roof, a covering supported by said board and mounted over and extending away from each vent part with at least a portion of said covering spaced from said passage means, flashing means contacting and extending adjacently upwardly along each vent part, said flashing means terminating spacedly from said covering and constituting means for forming a barrier against the ingress of wind driven moisture downwardly into said passage means of the vent part while providing an opening with said cover to allow air flow from under said roof to exhaust through the vent part passage means.

12. The combination of claim 11 wherein said covering is mounted to said board and spaced from said vent part.

13. The combination in claim 11 wherein said flashing means extends outwardly toward said covering.

14. The combination of claim 11 wherein said covering is tile.

15. A vent for a roof having a ventilation opening, a vent part mounted over said ventilation opening, said vent part having passage means for exhausting air from under said roof, a covering mounted over and extending away from said vent part with at least a portion of said covering spaced from said passage means, flashing means extending upwardly along said vent part and outwardly toward said covering, said flashing means terminating spacedly from said covering and constituting means for forming a barrier against the ingress of wind driven moisture downwardly into said vent part passage means while providing an opening with said covering to allow air flow from under said roof to exhaust toward said vent part passage means, roof sheeting outlining said ventilation opening, said flashing means including a first flashing part and a second flashing part, said first flashing part extending along said sheeting and upwardly along said vent part, and said second flashing part overlying said first flashing part, said second flashing part including an outturned flange terminating spacedly from said covering.

16. The vent of claim 15 wherein said covering is spaced from said vent part.

17. A roof having a ventilation opening, a board extending longitudinally over said ventilation opening, said board having opposite sides, a portion of said opening being exposed and located adjacent to each of said sides of said board, a vent part attached to each side of said board over a said opening portion, said vent part having passage means for exhausting air from under said roof, a covering supported by said board and mounted over and extending away from each vent part with at least a portion of said covering spaced from said passage means, flashing means extending adjacently upwardly along each vent part, said flashing means terminating spacedly from said covering and constituting means for forming a barrier against the ingress of wind driven moisture downwardly into said passage means of the vent part while providing an opening with said cover to allow air flow from under said roof to exhaust through the vent part passage means, roof sheeting outlining said ventilation opening, each flashing means including a first flashing part and a second flashing part, said first flashing part extending along said sheeting and upwardly along a said vent part, said second flashing part overlying said first flashing part, said second flashing part including an outturned flange terminating spacedly from said covering.

18. The vent of claim 17 wherein said covering is spaced from said vent part.

19. A vent for a roof having a ventilation opening, a vent part mounted over said ventilation opening, said vent part having vertical passage means for exhausting air from under said roof, a covering mounted over and extending away from said vent part with at least a portion of said covering spaced form said passage means, flashing means extending upwardly along said vent part and outwardly toward said covering, said flashing means terminating spacedly from said covering and constituting means for forming a barrier against the ingress of wind driven moisture downwardly into said vent part passage means while providing an opening with said covering to allow air flow from under said roof to exhaust toward said vent part passage means.

20. The vent of claim 19 wherein said covering is spaced from said vent part.

* * * * *